US008444532B1

(12) United States Patent
Barcena

(10) Patent No.: US 8,444,532 B1
(45) Date of Patent: May 21, 2013

(54) FITNESS PLATFORM HAVING A PLURALITY OF INTERCHANGEABLE SURFACES

(76) Inventor: Juan Carlos Barcena, Allen, TX (US)

( * ) Notice: Subject to any disclaimer, the term of this patent is extended or adjusted under 35 U.S.C. 154(b) by 0 days.

(21) Appl. No.: 12/419,699

(22) Filed: Apr. 7, 2009

(51) Int. Cl.
*A63B 21/00* (2006.01)
*A63B 22/00* (2006.01)

(52) U.S. Cl.
USPC ..... 482/51; 482/132

(58) Field of Classification Search
USPC ..... 482/51–52, 129–130, 132, 140
See application file for complete search history.

(56) References Cited

U.S. PATENT DOCUMENTS

| | | | | | |
|---|---|---|---|---|---|
| 3,604,726 | A | | 9/1971 | Tracy | |
| 3,716,229 | A | | 2/1973 | Van Der Cleyen et al. | |
| 4,892,305 | A | * | 1/1990 | Lynch | 482/132 |
| 5,533,948 | A | * | 7/1996 | Wilkinson | 482/27 |
| 5,645,510 | A | * | 7/1997 | Wilkinson | 482/27 |
| 5,651,753 | A | * | 7/1997 | Wilkinson | 482/52 |
| 5,842,955 | A | * | 12/1998 | Wilkinson | 482/52 |
| 6,063,013 | A | | 5/2000 | Vathappallil | |
| 6,110,073 | A | | 8/2000 | Saur et al. | |
| 6,132,338 | A | * | 10/2000 | Shifferaw | 482/30 |
| 6,461,285 | B1 | | 10/2002 | Theunissen et al. | |
| 6,663,545 | B2 | | 12/2003 | Wilson | |
| 6,872,175 | B2 | | 3/2005 | Lin | |
| 6,942,604 | B2 | | 9/2005 | Teff | |
| 7,008,356 | B2 | | 3/2006 | Hung | |
| 7,300,392 | B1 | * | 11/2007 | Curran | 482/146 |
| 7,625,294 | B1 | * | 12/2009 | Isaac et al. | 473/218 |
| 7,753,831 | B2 | * | 7/2010 | Langer et al. | 482/146 |
| 2007/0066454 | A1 | * | 3/2007 | Foley | 482/92 |

* cited by examiner

*Primary Examiner* — Stephen Crow
(74) *Attorney, Agent, or Firm* — Michael Diaz

(57) ABSTRACT

An exercise apparatus having a plurality of upper and lower interchangeable surfaces. The apparatus includes a plurality of interchangeable upper surfaces sized and shaped to fit on an upper side of the fitness platform and a plurality of interchangeable lower surfaces sized and shaped to fit on a lower side of the fitness platform. A user selects one of the plurality of interchangeable upper surface and affixes the selected upper surface to the upper side of the fitness platform and selects one of the plurality of interchangeable lower surfaces and affixes the selected lower surface to the lower side of the fitness platform. The upper surfaces may include an incline surface, a flat upper surface, and a cushion surface. The lower surfaces may include a stable base, an unstable base, and a surface having a plurality of pivotable wheels. The user selects the upper and lower surfaces for the desired exercise.

16 Claims, 10 Drawing Sheets

FITNESS PLATFORM HAVING A PLURALITY OF INTERCHANGEABLE SURFACES

BACKGROUND OF THE INVENTION

1. Field of the Invention

This invention relates to exercise equipment. Specifically, and not by way of limitation, the present invention relates to a fitness platform having a plurality of interchangeable surfaces.

2. Description of the Related Art

Exercising, whether at a gymnasium or at home, is quite popular in today's modern society. Without a doubt, performing frequent exercises contributes significantly to an individual's health. With this ever-increasing popularity, technology has been used to assist an individual in exercising effectively and efficiently. There is a wide variety of equipment available which may be used to exercise various parts of the individual's body. In addition, various equipment devices are used to enhance the tone, strength, balance, and overall fitness of the individual. For example, there are core boards, balance boards, abdominal rollers, Bosu® balls, step up boards and resistance bands. However, these devices suffer from some severe disadvantages. In particular, far too many devices are necessary to perform the various exercises to accomplish the goal of effective toning, strengthening, and enhancing balance. To accomplish these many varied exercises, an individual must own or have access to a wide variety of exercise devices. Because of the number and variety of these devices, the cost may be substantial. Furthermore, these various devices take up precious floor space. An apparatus is needed which enables an individual to accomplish these various exercises with a single piece of equipment.

Thus, it would be advantageous to have an apparatus which enables an individual to selectively choose one or more surfaces of a platform for performing various desired exercises. It is an object of the present invention to provide such an apparatus.

SUMMARY OF THE INVENTION

In one aspect, the present invention is directed to an exercise apparatus. The apparatus includes a plurality of interchangeable upper surfaces sized and shaped to fit on an upper side of the fitness platform and a plurality of interchangeable lower surfaces sized and shaped to fit on a lower side of the fitness platform. A user selects one of the plurality of interchangeable upper surface and affixes the selected upper surface to the upper side of the fitness platform and selects one of the plurality of interchangeable lower surfaces and affixes the selected lower surface to the lower side of the fitness platform. The upper surfaces may include an incline surface, a flat upper surface, and a cushion surface. The lower surfaces may include a stable base, an unstable base, and a surface having a plurality of pivotable wheels. The user selects the upper and lower surfaces for the desired exercise.

DESCRIPTION OF THE INVENTION

Figure 1:
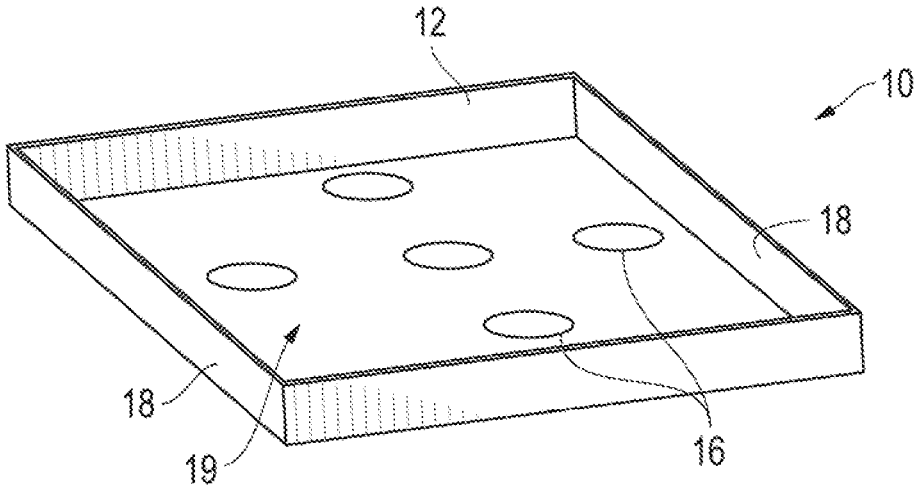
FIG. 1 is a front perspective view of a fitness platform in one embodiment of the present invention.
Figure 2:
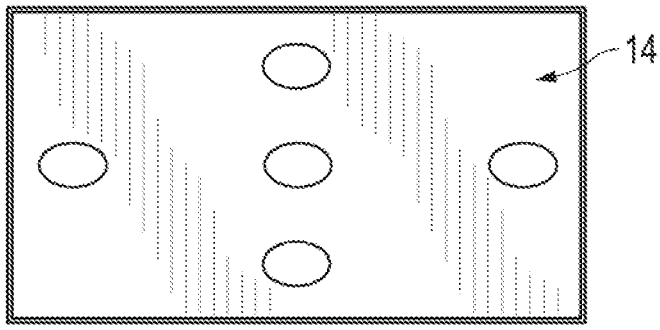
FIG. 2 is a bottom view of the fitness platform.

The present invention is a fitness platform having a plurality of interchangeable surfaces. FIG. 1 is a front perspective view of a fitness platform 10 in one embodiment of the present invention. The fitness platform is a substantially planar surface having an upper side 12 and a lower side 14. The fitness platform may be constructed of any durable material, such as plastic, metal, a composite material, or wood. FIG. 2 is a bottom view of the fitness platform 10. The bottom side may optionally include a plurality of receiving mechanisms 16 for attaching the various removable surfaces to the fitness platform. In one embodiment, the upper side of the fitness platform includes raised borders 18 surrounding an interior 19 of the fitness platform 10.

Figure 3A:
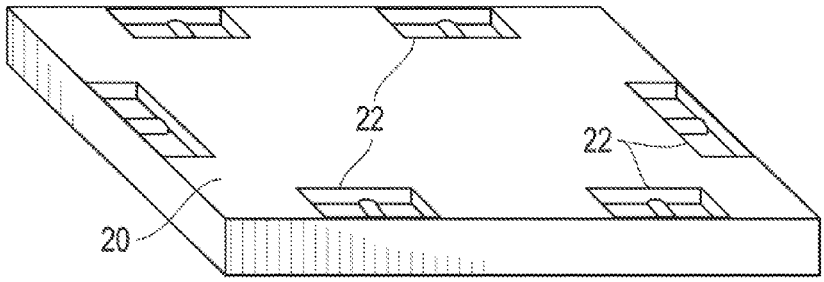
FIG. 3A is a front perspective view of a flat upper surface for use on the upper side of the fitness platform.
Figure 3B:
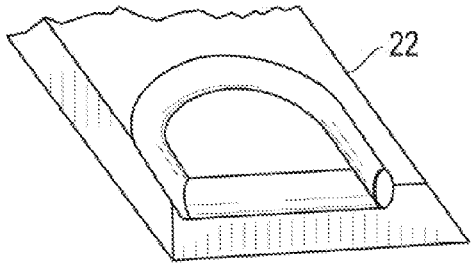
FIG. 3B is an enlarged perspective view of the retaining device of FIG. 3A.
Figure 4:
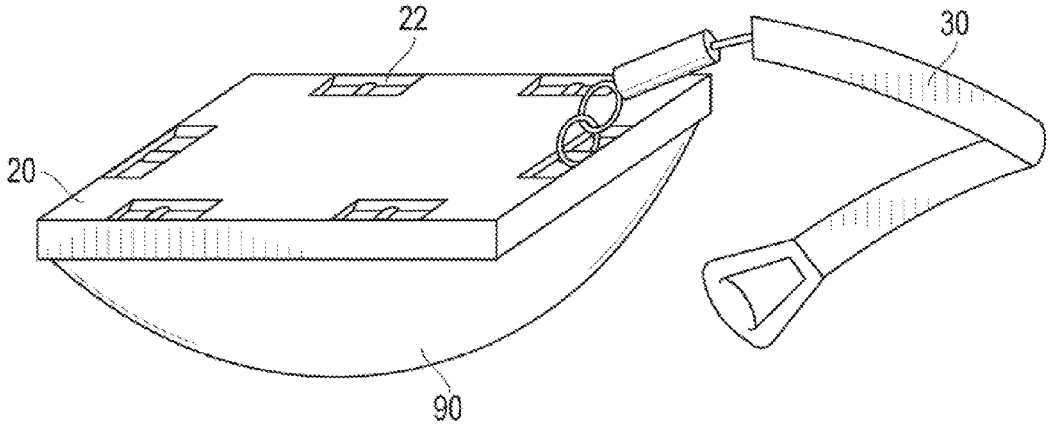
FIG. 4 is a front perspective view of the fitness platform having the flat upper surface and an adjustable resistance band.

FIG. 3A is a front perspective view of a flat upper surface 20 for use on the upper side 12 of the fitness platform 10. The upper surface is substantially planar and may be constructed of any durable material. The flat upper surface presents a flat planar surface. In one embodiment, the flat upper surface 20 may include a plurality of retaining devices 22 providing rounded loops for attachment of resistance bands. The retaining devices may be shaped and sized to hold resistance bands. FIG. 3B is an enlarged perspective view of the retaining device 22 of FIG. 3A. FIG. 4 is a front perspective view of the fitness platform 10 having the flat upper surface 20 and an adjustable resistance band 30. The resistance band is attached to one of the retaining devices 22. The flat upper surface is affixed to the upper side of fitness platform. The flat upper surface may be sized and shaped to be positioned within the interior portion of the fitness platform (within the raised border 18).

Figure 5:
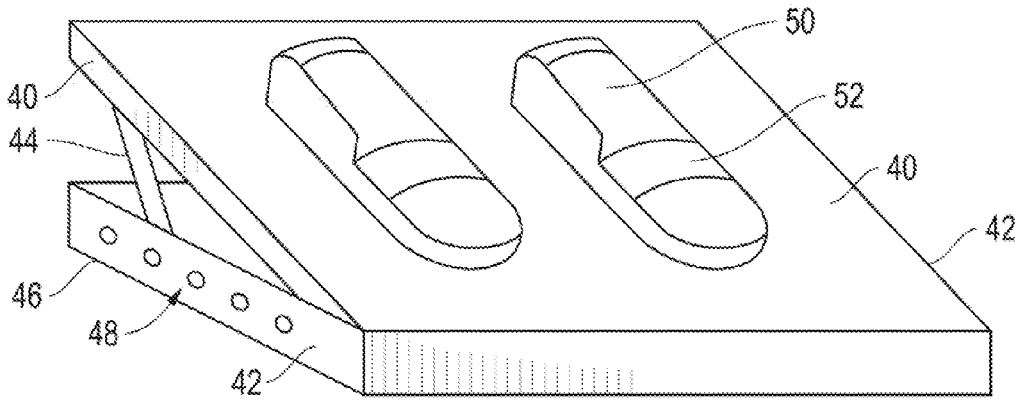
FIG. 5 is a front perspective view of an adjustable incline surface in another embodiment of the present invention.
Figure 6:
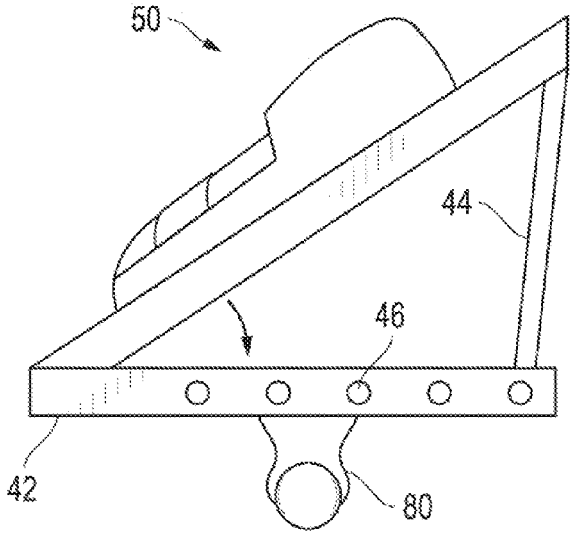
FIG. 6 is a side view of the adjustable upper incline surface.

Another surface may be exchanged for the flat upper surface 20 on the fitness platform. FIG. 5 is a front perspective view of an adjustable incline surface 40 in another embodiment of the present invention. FIG. 6 is a side view of the adjustable incline surface 40. The adjustable incline surface may be adjusted to different angles. In one embodiment, the adjustable incline surface is pinned at one end 42 on each side of the incline surface, thereby allowing the incline surface to pivot about each end. The incline surface may then be held at a desired angle by a bar 44. The bar may be held in place by insertion of the end of the bar into one of a plurality of openings 46 located on a side 48 of the fitness platform 10. In one embodiment, the adjustable incline surface includes shoe retention devices 50 having straps 52 for retaining an individual's shoes within the devices. The incline surface may be permanently affixed to the fitness platform or removable for accommodating other interchangeable surfaces. In the embodiment where the incline surface is removable, the incline surface may be sized and shaped to fit within the interior portion 19 of the fitness platform.

Figure 7:
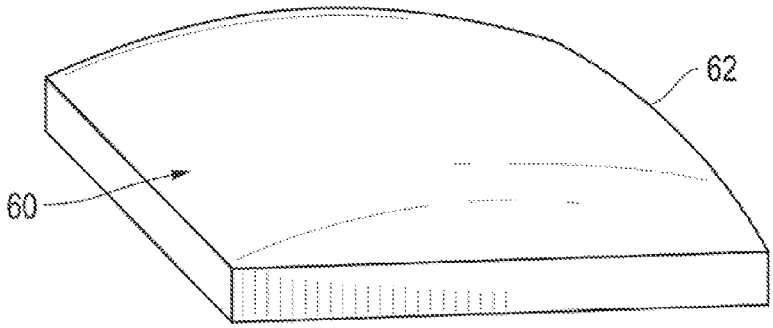
FIG. 7 is a front perspective view of a cushion surface for use on the upper side of the fitness platform.

FIG. 7 is a front perspective view of a cushion surface 60 for use on the upper side 12 of the fitness platform 10. The cushion surface may include a cushion upon an upper surface 62. In one embodiment, an inflatable flexible bladder such as a Bosu® material may be utilized for the cushion surface 60. The cushion surface may be sized and shaped to fit within the fitness platform 10. In particular, the perimeter of the cushion surface may be slightly smaller than the interior portion 19 of the fitness platform, thereby fitting within the raised borders 18.

Figure 8:
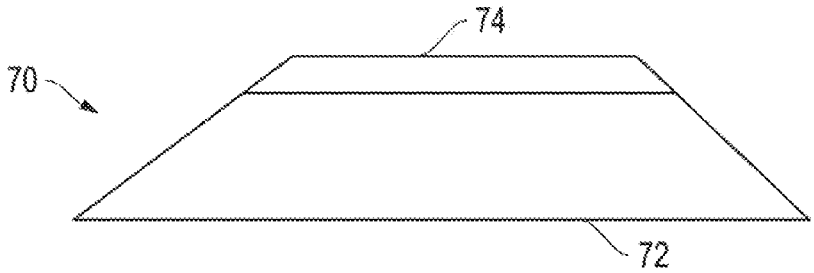
FIG. 8 is a side view of a stable base surface in another embodiment of the present invention.

The present invention may also incorporate interchangeable lower surfaces. FIG. 8 is a side view of a stable base surface 70 in another embodiment of the present invention. The stable base surface includes a planar lower surface 72. In one embodiment, the planar lower surface is wider than an upper planar surface 74. The upper planar surface is affixed to the lower side 14 of the fitness platform. In this embodiment, the fitness platform remains in a stable, immobile configuration. However, the stable base surface may be any shape which provides a stable and immobile base for the fitness platform.

Figure 9:
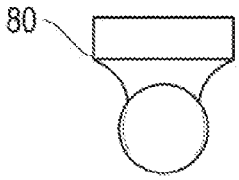
FIG. 9 is a side view of a pivotable wheel in another embodiment of the present invention.

The present invention may also utilize pivotable wheels on the lower side 14 of the fitness platform 10. FIG. 9 is a side view of a pivotable wheel 80 in another embodiment of the present invention. In one embodiment, a plurality of wheels is affixed to the lower side of the fitness platform.

Figure 10:
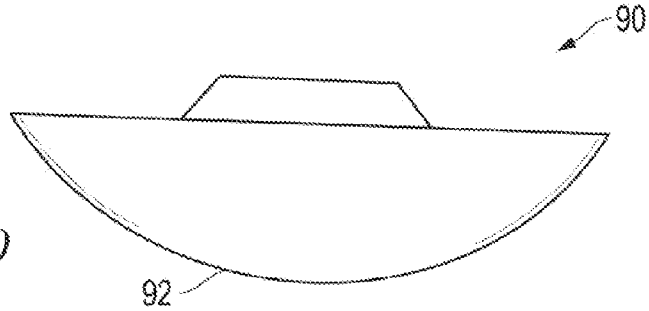
FIG. 10 is a side view of an unstable base in another embodiment of the present invention.

FIG. 10 is a side view of an unstable base 90 in another embodiment of the present invention. The unstable base is affixed to the lower side 14 of the fitness platform 10. The unstable base may include a lower curved surface area 92, thereby allowing the fitness platform to rock. Various sizes of unstable bases may be interchanged to provide the level of instability desired, dependent upon the type of curve and shape of the lower surface area. The unstable base may be configured in any shape to enable an unstable surface for the user. In one embodiment, an inflatable flexible bladder such as a Bosu® device may be utilized for the unstable base. In another embodiment, the unstable platform may be constructed of a hard plastic.

The lower surfaces may be retained upon the fitness platform 10 by any attachment device. The selected upper surface may be positioned into a recessed area sized and shaped to receive the upper surface (e.g., a border sized slightly larger than the upper surface). Thus, in one embodiment, the upper surface is not attached directly to the fitness platform. In another embodiment, the lower surface is retained by hook and pile straps. In another embodiment, the lower surface is held in place by screws. In still another embodiment, the lower surface is held in place by retention bands. It should be understood that any retention device may be utilized to hold the upper and/or lower surface in place and still remain in the scope of the present invention.

Figure 11:
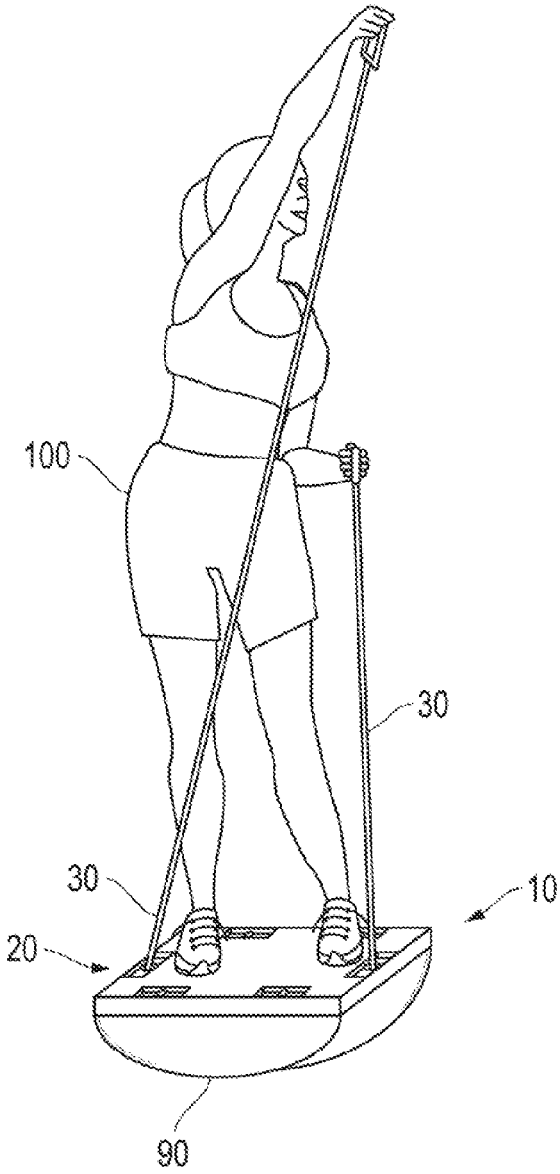
FIG. 11 is a front perspective view of the fitness platform having an unstable base.

The present invention may utilize the various interchangeable upper and lower surfaces to perform a wide variety of exercises. FIG. 11 is a front perspective view of the fitness platform 10 having an unstable base 90. As illustrated in FIG. 11, the flat upper surface is positioned upon the upper side 12 of the fitness platform 10. The resistance bands 30 are held within the retaining devices 22. A user 100 is located on top of the flat upper surface and performs cross body raises with the resistance bands upon an unstable surface. The lower surface is curved allowing the base to rock. This exercise enables the user to enhance the body's tone, strength and balance.

Figure 12:
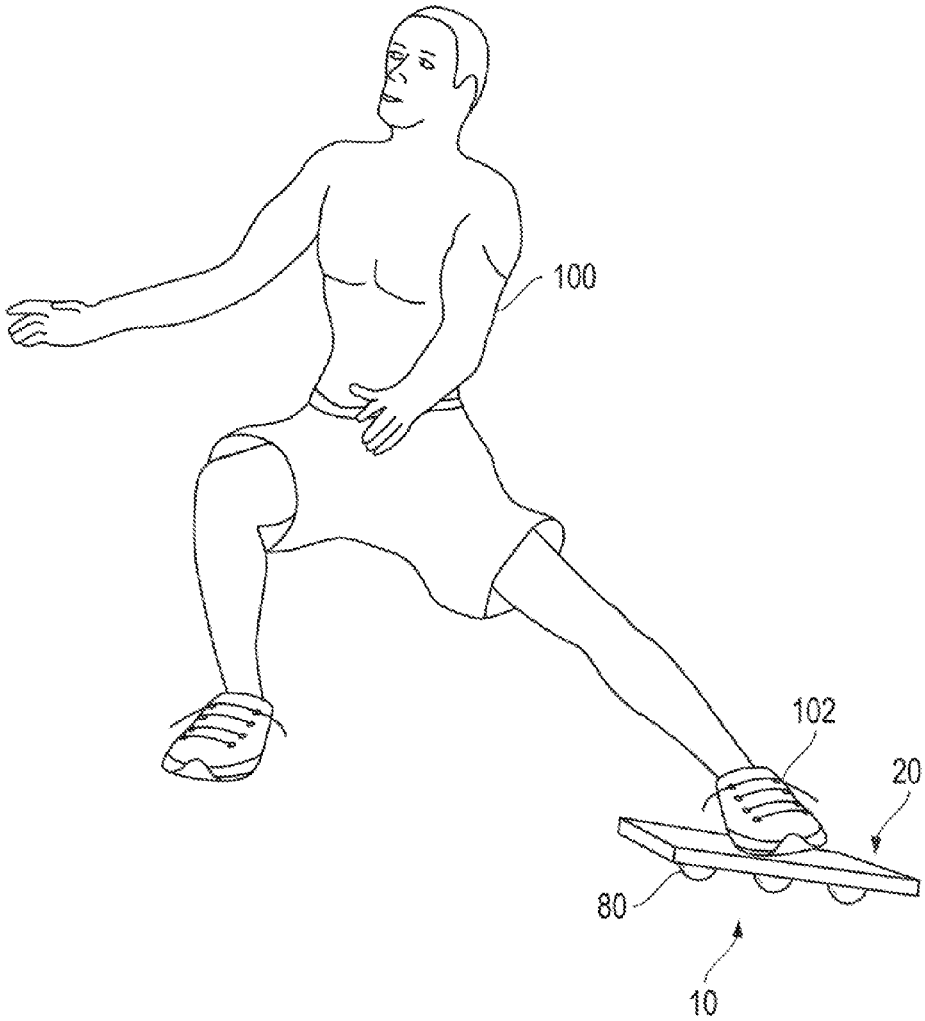
FIG. 12 is a front perspective view of the user performing side lunges on the fitness platform.

FIG. 12 is a front perspective view of the user 100 performing side lunges on the fitness platform 10. In this embodiment, wheels 80 are affixed to the lower side 12 of the fitness platform. The flat upper surface 20 is also depicted in FIG. 12. The user positions a foot 102 on the flat upper surface 20. The fitness platform is allowed to move about the ground on the wheels 80.

Figure 13:
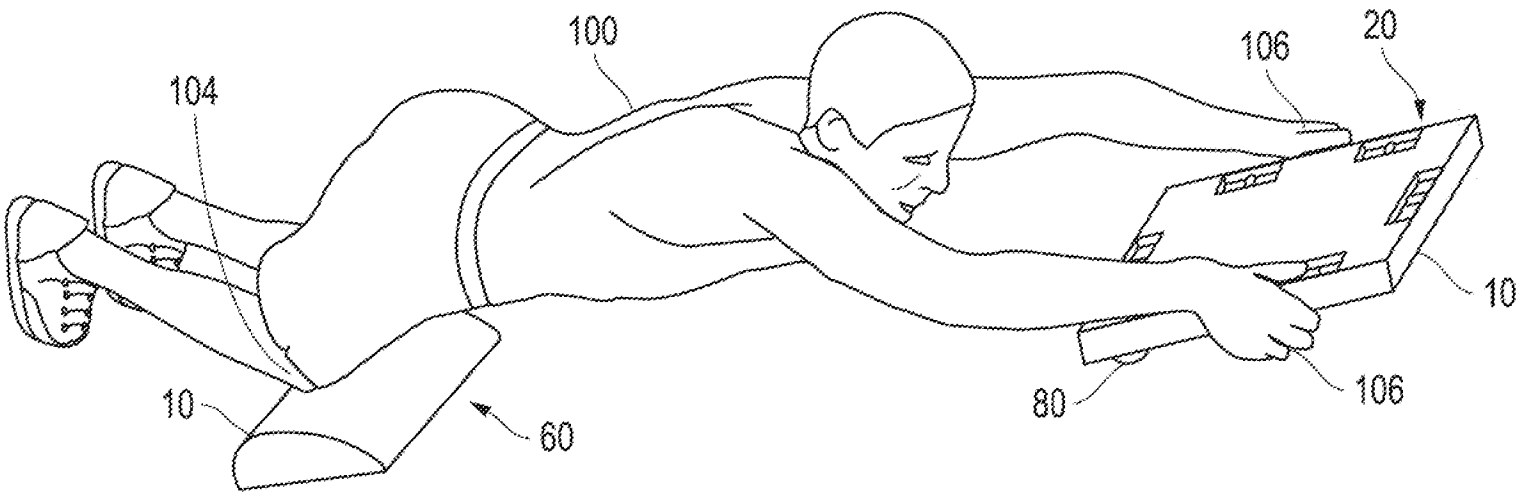
FIG. 13 illustrates a front perspective view of the user exercising with two fitness platforms.

FIG. 13 illustrates a front perspective view of the user exercising with two fitness platforms 10. The user may utilize a first fitness platform 10 with the cushion 60 on the upper surface and a second fitness platform having the wheels 80 on the lower surface and a flat upper surface 20. The user may position knees 104 on the cushion 60 and extend the body with hands 106 holding the second fitness platform.

Figure 14:
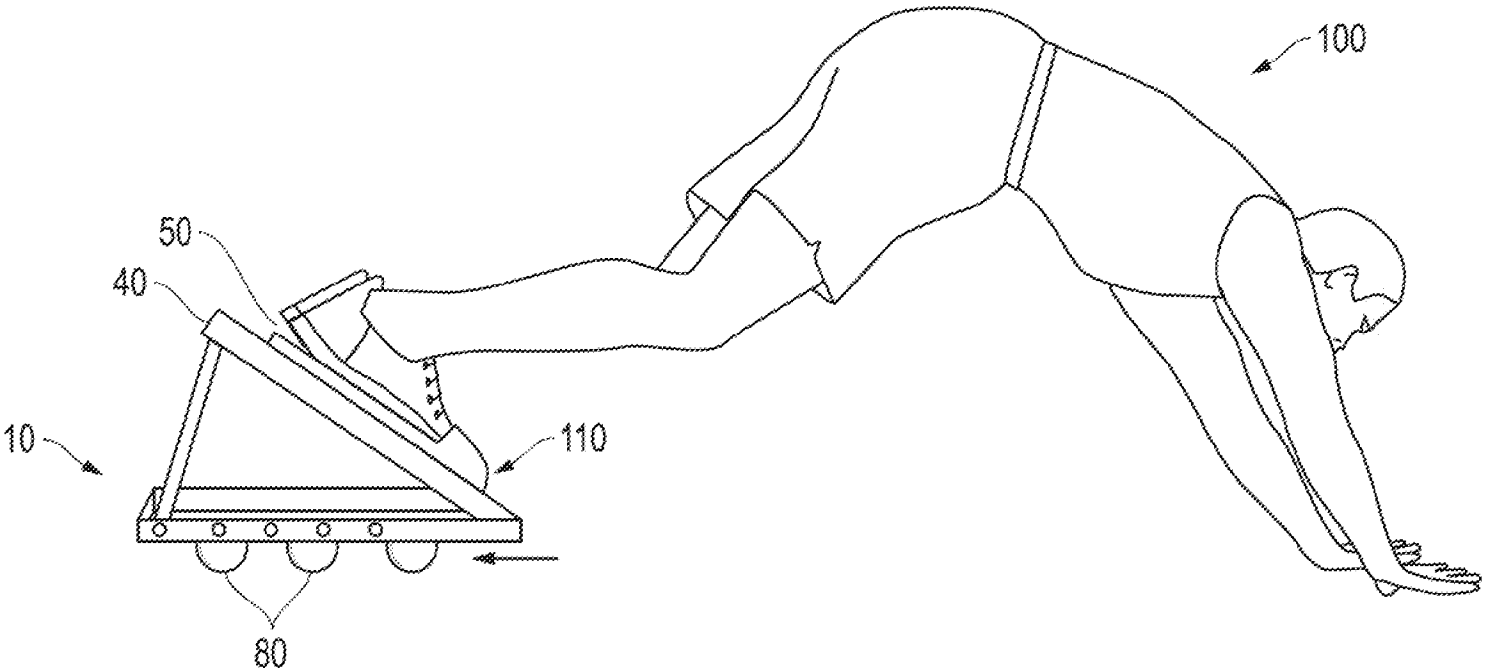
FIG. 14 is a front perspective view of the user using the incline surface on the fitness platform to perform exercises.

FIG. 14 is a front perspective view of the user 100 using the incline surface 40 on the fitness platform to perform exercises. The user positions feet 110 on the incline surface 40. The fitness platform also includes the pivotable wheels 80 on the lower side. The user may perform abdominal roll-outs with hands on the floor and feet on the shoe retention devices 50.

Figure 15:
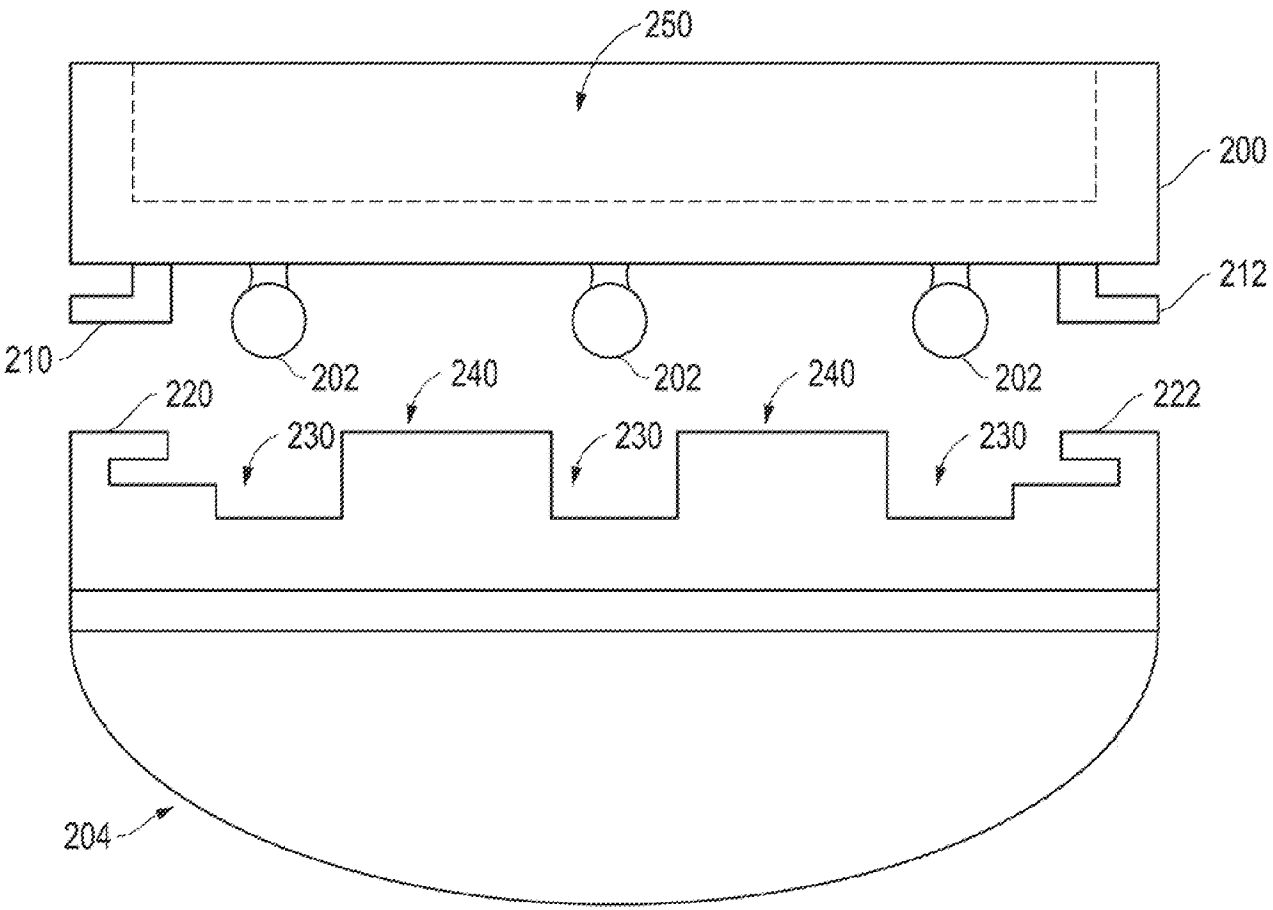
FIG. 15 is a front view of a fitness platform having permanently attached wheels detached from an unstable lower surface in another embodiment of the present invention.
Figure 16:
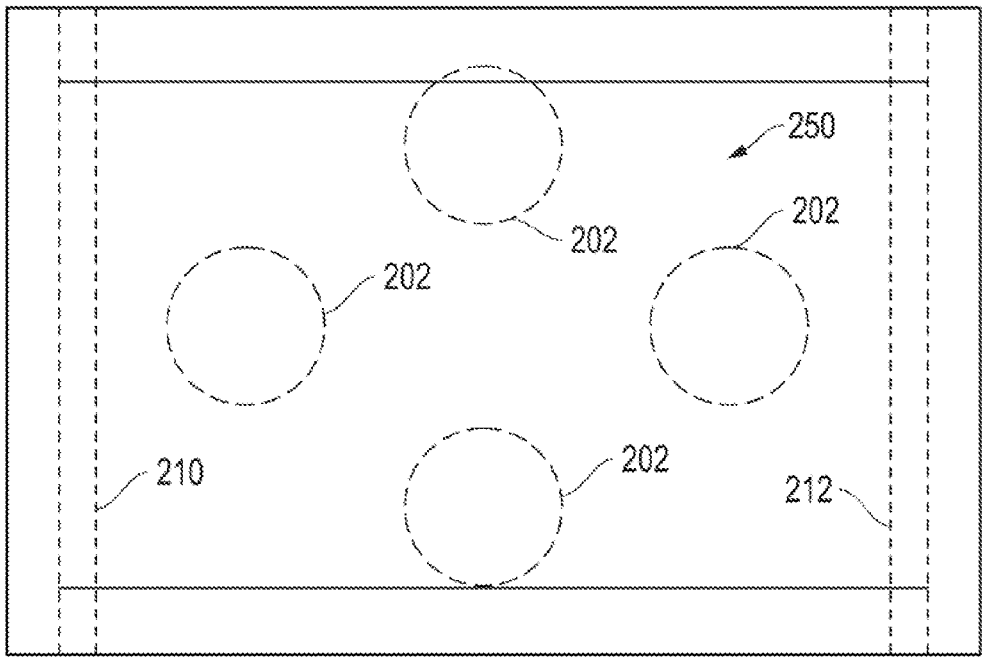
FIG. 16 is a top view of the fitness platform.

In another embodiment, the fitness platform may include wheels permanently affixed to the lower side 14 of the fitness platform. FIG. 15 is a front view of a fitness platform 200 having permanently attached wheels 202 detached from an unstable lower surface 204 in another embodiment of the present invention. FIG. 16 is a top view of the fitness platform 200. In this embodiment, the wheels stay permanently attached to the bottom of the fitness platform. Thus, if the user desires to utilize the wheels, the detachable lower surface (e.g., unstable/stable base) is removed. However, if another type of lower base is desired, the lower surface is attached to the bottom of the fitness platform. As depicted in FIG. 15, the fitness platform 200 includes rails 210 and 212 running along an entire edge of the fitness platform on each side. The rails correspond to opposing rails 220 and 222 running along two edges of an upper side of the selected lower surface. The lower surface also includes indentations 230 for accommodating the wheels 202. In operation, the lower surface is slid upon the rails 210 and 212. When a lower surface is used, the wheels are covered by the lower surface and are not useable. In addition, the lower surface, between the indentation, includes supporting surface areas 240, which when position adjacent the fitness platform, provide support to the platform. Additionally, the fitness platform 200 includes a recessed area 250 for accommodating an upper surface (not shown) in a similar manner as the fitness platform 10. It should be understood, that an configuration may be used to affixed the lower surface to the lower side of the fitness platform 200 and is not limited to the rail configuration shown in FIG. 15. Furthermore, the detachable upper surface may be affixed or held secure against the fitness platform by any manner and also is not limited to the recessed portion of the fitness platform.

Figure 17:
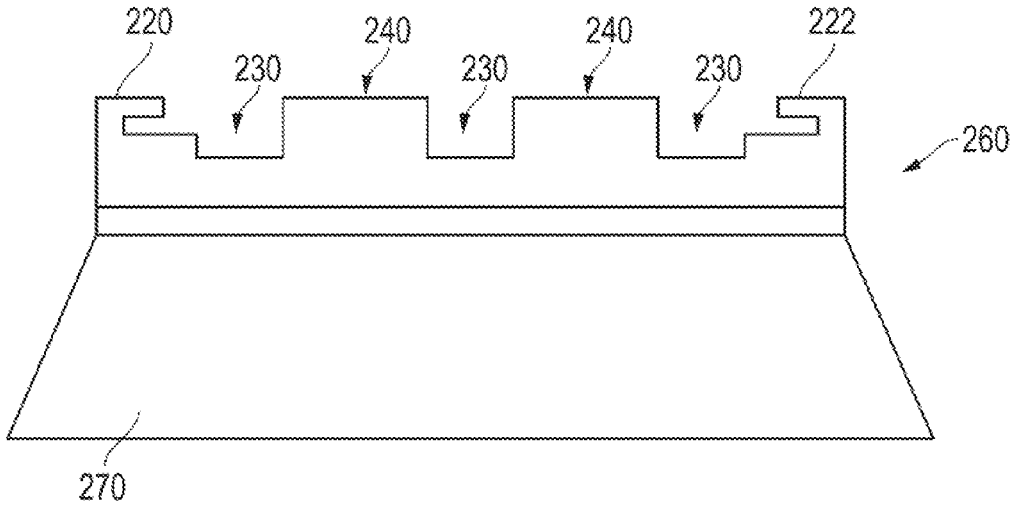
FIG. 17 is a front view of a stable lower surface for use with the fitness platform.

In a similar fashion as discussed with the fitness platform 10, the fitness platform 200 may utilize various types of upper and lower surfaces. FIG. 17 is a front view of a stable lower surface 260 for use with the fitness platform 200. The stable lower surface includes the rails 220 and 222 for use with corresponding rails 210 and 212 on the fitness platform. Additionally, the stable lower surface includes a stable and solid base 270.

It should be understood that the type of upper and lower surfaces illustrated are exemplary only. Other upper and lower surfaces, configured in a wide variety of ways may be utilized. Furthermore, the present invention is not limited to the type of exercises illustrated. The user may perform various exercises in combination with one or more fitness boards.

The present invention enables the user to selectively interchange the upper and lower surfaces for the desired exercises. The present invention utilizes interchangeable upper and lower surfaces enabling a person to perform a full body workout in a variety of ways to tone, enhance strength and improve overall balance and stability. The type of upper and lower surfaces determines the type and difficulty of the exercise to be performed.

The present invention provides several improvements over existing devices. The present invention enables a user to select the type of upper and lower surface to perform the desired exercise. The present invention performs the function of several exercise devices in one single apparatus, thereby decreasing cost and floor space.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An exercise apparatus, the apparatus comprising:

a fitness platform;

a plurality of interchangeable upper surfaces sized and shaped to fit on an upper side of the fitness platform;

wherein each upper surface is configured to enable a user to perform a different and particular type of exercise;

wherein the upper surface provides a direct contact point for the user to interact with the apparatus while exercising;

means for retaining one of the plurality of interchangeable upper surfaces on the fitness platform;

a plurality of interchangeable lower surfaces sized and shaped to fit on a lower side of the fitness platform;

means for retaining one of the plurality of interchangeable lower surfaces on the fitness platform;

wherein each interchangeable lower surface is configured to enable a user to perform a particular type of exercise;

wherein a plurality of wheels are affixed to the lower side of the fitness platform;

wherein the lower surface covers the plurality of wheels when one of the lower surfaces is retained upon the fitness platform;

wherein the means for retaining one of the plurality of interchangeable lower surfaces includes:

a plurality of fitness platform rails located on the lower side of the fitness platform; and a plurality of lower surface rails located on an upper side of the lower surface corresponding to the plurality of fitness platform rails;

wherein a user selects one of the plurality of interchangeable upper surface and affixes the selected upper surface to the upper side of the fitness platform and selects one of the plurality of interchangeable lower surfaces and affixes the selected lower surface to the lower side of the fitness platform.

2. The exercise apparatus according to claim 1 wherein the fitness platform is substantially planar.

3. The exercise apparatus according to claim 2 wherein the fitness platform includes a raised border surrounding a perimeter of the fitness platform.

4. The exercise apparatus according to claim wherein one of the plurality of upper surfaces is a substantially flat upper surface.

5. The exercise apparatus according to claim 4 wherein the flat upper surface includes a retaining device for retaining a resistance band on the fitness board.

6. The exercise apparatus according to claim 1 wherein one of the plurality of upper surfaces is an incline surface.

7. The exercise apparatus according to claim 6 wherein the incline surface includes means for adjusting an incline angle of the incline surface.

8. The exercise apparatus according to claim 6 wherein the incline surface includes a shoe retention device for retaining a shoe of the user on the incline surface.

9. The exercise apparatus according to claim 1 wherein one of the plurality of upper surfaces is a cushion upper surface.

10. The exercise apparatus according to claim 1 wherein one of the plurality of lower surfaces is a stable base for stabilizing the fitness platform.

11. The exercise apparatus according to claim 1 wherein one of the plurality of lower surfaces is an unstable base providing an instability to the fitness platform, the unstable base being attached to the fitness platform to allow controlled rocking.

12. The exercise apparatus according to claim 11 wherein the unstable base includes a curved lower surface.

13. The exercise apparatus according to claim 1 wherein one of the lower surfaces includes a plurality of wheels for moving the fitness platform on a floor.

14. The exercise apparatus according to claim 1 wherein the lower surface is removed from the fitness platform to utilize the plurality of wheels.

15. The exercise apparatus according to claim 12, wherein the curved lower surface is made of an inflatable flexible bladder.

16. An exercise system, the system comprising:

a fitness platform;

a plurality of interchangeable upper surfaces sized and shaped to fit on an upper side of the fitness platform;

wherein a first upper surface of the plurality of interchangeable upper surfaces is an incline surface;

wherein a second upper surface of the plurality of interchangeable upper surfaces is a flat upper surface;

wherein a third upper surface of the plurality of interchangeable upper surfaces is a cushion surface;

means for retaining one of the plurality of interchangeable upper surfaces on the fitness platform;

wherein each upper surface is configured to enable a user to perform a particular and different type of exercise;

wherein the upper surface provides a direct contact point for the user to interact with the apparatus while exercising;

a plurality of interchangeable lower surfaces sized and shaped to fit on a lower side of the fitness platform;

wherein a first lower surface of the plurality of interchangeable lower surfaces is a stable base;

wherein a second lower surface of the plurality of interchangeable lower surfaces is an unstable base, that allows the user to rock controllably;

wherein a third lower surface of the plurality of interchangeable lower surfaces includes a plurality of pivotable wheels; and means for retaining one of the plurality of interchangeable lower surfaces on the fitness platform;

wherein the user selects one of the plurality of interchangeable upper surface and affixes the selected upper surface to the upper side of the fitness platform and selects one of the plurality of interchangeable lower surfaces and affixes the selected lower surface to the lower side of the fitness platform.

* * * * *